US009337541B2

(12) United States Patent
Pintos et al.

(10) Patent No.: US 9,337,541 B2
(45) Date of Patent: May 10, 2016

(54) INTEGRATED MEANDER RADIO ANTENNA

(71) Applicant: COMMISSARIAT A L'ENERGIE ATOMIQUE ET AUX ENERGIES ALTERNATIVES, Paris (FR)

(72) Inventors: Jean-François Pintos, Saint-Blaise-du-Buis (FR); Cyril Jouanlanne, Grenoble (FR); Christophe Delaveaud, St Jean de Moirans (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 4 days.

(21) Appl. No.: 14/555,858

(22) Filed: Nov. 28, 2014

(65) Prior Publication Data

US 2015/0145729 A1 May 28, 2015

(30) Foreign Application Priority Data

Nov. 28, 2013 (FR) ..... 13 61794

(51) Int. Cl.

| | |
|---|---|
| ***H01Q 1/24*** | (2006.01) |
| ***H01Q 9/42*** | (2006.01) |
| ***H01Q 9/04*** | (2006.01) |
| ***H01Q 1/38*** | (2006.01) |
| ***H01Q 9/40*** | (2006.01) |

(52) U.S. Cl.

CPC ..... *H01Q 9/0414* (2013.01); *H01Q 1/243* (2013.01); *H01Q 1/38* (2013.01); *H01Q 9/40* (2013.01); *H01Q 9/42* (2013.01)

(58) Field of Classification Search

CPC ..... H01Q 1/24; H01Q 1/243; H01Q 1/38; H01Q 9/0414; H01Q 9/42

USPC ..... 343/702, 700 MS, 895

See application file for complete search history.

(56) References Cited

U.S. PATENT DOCUMENTS

| | | | | |
|---|---|---|---|---|
| 6,184,836 | B1 * | 2/2001 | Ali | H01Q 1/242 343/700 MS |
| 7,106,253 | B2 * | 9/2006 | Yuanzhu | H01Q 1/3291 343/700 MS |
| 2009/0108996 | A1 | 4/2009 | Day | |

FOREIGN PATENT DOCUMENTS

| | | | |
|---|---|---|---|
| CN | 102354804 | A | 2/2012 |
| EP | 1441415 | A1 | 7/2004 |
| JP | 2003142931 | A | 5/2003 |
| WO | 2012/108071 | A1 | 8/2012 |

OTHER PUBLICATIONS

A. Khaleghi, et al., "A Dual Band Back Coupled Meanderline Antenna for Wireless LAN Applications", 2005 IEEE 61st vehicular Technolog Conference, May 30-Jun. 1, 2005, pp. 226-229, vol. 1, IEEE, Piscataway, NJ, USA, XP010855386.

* cited by examiner

*Primary Examiner* — Hoang V Nguyen

(74) *Attorney, Agent, or Firm* — Baker & Hostetler LLP

(57) ABSTRACT

In the field of telecommunications antennas suitable for portable communication casings, a monopole radio antenna is provided, including an etched conducting surface, including a ground plane, a structure of conducting lines, and a signal injection point in the structure of conducting lines. The structure of conducting lines comprises a first meander conducting line having multiple strands elongated in a first direction, a second meander conducting line symmetrical to the first conducting line in relation to a median line passing in the plane via the injection point and perpendicular to a general direction of elongation of the strands, the two lines starting from the injection point, and a common surface connected to the ends of the conducting lines distant from the injection point. The antenna is less sensitive to radiation efficiency reductions due to the presence of a plastic hood enclosing the antenna.

6 Claims, 4 Drawing Sheets

INTEGRATED MEANDER RADIO ANTENNA

CROSS-REFERENCE TO RELATED APPLICATION

This application claims priority to foreign French patent application No. FR 1361794, filed on Nov. 28, 2013, the disclosure of which is incorporated by reference in its entirety.

FIELD OF THE INVENTION

The invention relates to radio antennas, and more particularly to antennas of portable devices that must be miniaturised even when the operating frequency bands are relatively low, for example around 500 MHz.

BACKGROUND

Miniaturisation of an antenna consists in providing antenna dimensions of less than around one sixth of the wavelength, and the efficiency of the antenna is reduced due to the fact of these small dimensions. In fact, a dipole antenna optimised from the point of view of efficiency should have dimensions in the order of the half-wavelength, i.e., for example, 15 cm for 500 MHz. A miniaturised antenna would instead have a length of 5 centimetres in its largest dimension, more suitable for a portable communication device that must be capable of being handheld.

Problems encountered in antenna miniaturisation include interactions between the antenna and its immediate environment, and one object of the invention is to provide an antenna geometry that minimises these interactions, which would be detrimental to the efficiency of the antenna.

Meander antennas have already been proposed in which the antenna is formed by a conducting wire folded over itself in order to retain a sufficient total wire length (close to one quarter of the wavelength), while restricting the overall size.

The 1 shows the principle of a monopole meander antenna, made up of a wire F mounted above a ground plane M and folded over itself. The height above the ground plane is around three times less than the total length of the unfolded wire.

FIG. 2 shows a different configuration in which the directions of elongation of the antenna wire are parallel and not perpendicular to the ground plane, and in which the wire is folded multiple times. In the example shown, there are ten elbows of folding in the area of which the direction of the wire is reversed. The height above the ground plane is, for example, five to ten times less than the total length of the unfolded wire.

Antenna structures formed by etching of printed circuit boards have also been proposed. The conducting wires of the antenna and the ground plane are etched onto the surface of the board. The conducting wires can be etched on one surface of the board and the ground plane on a different surface of the board. The height is particularly reduced since it is limited to the thickness of the board and the conducting layers deposited on the board. FIG. 3 shows an example of this type of antenna; the left part of the figure shows one surface of the board, and the right part shows the opposite surface. The ground plane M is etched on one surface. An antenna wire F is etched onto a different surface.

FIG. 4 shows a different form of compact antenna etched onto a printed circuit board, in which the antenna wire is folded in a spiral. The ground plane, not shown, is located on a different surface of the board.

Finally, slot antennas have been proposed in the prior art, in which the electromagnetic radiation is generated in an open, elongated slot in a flat conducting structure etched onto one surface of a printed circuit, the other surface of which forms a ground plane. The wider the slot, the lower the operating frequency can be.

However, the miniaturised antenna structures proposed to date have reduced radiation efficiency, i.e. a low ratio of the received electric power (which is the power of the source for a suitable antenna) to the radiated power, when the antenna is placed in an unfavourable environment.

SUMMARY OF THE INVENTION

The antenna according to the invention is a monopole radio antenna including a ground plane and an etched conducting surface, the etched conducting surface including a structure of conducting lines and a signal injection point, characterised in that the structure of conducting lines comprises a first meander conducting line having multiple strands elongated in a first direction, a second meander conducting line symmetrical to the first conducting line in relation to a median plane perpendicular to the first direction, the two lines starting from the injection point, and a common surface connected to the ends of the conducting lines distant from the injection point.

The structure according to the invention evens out the distribution of the high electric fields better than enabled by a single-meander antenna of the prior art, especially in the case where the antenna is enclosed in a hood of plastic material (ABS), which will often be the case with telecommunication antennas associated with handheld portable electronic devices.

The multiple strands of the two meander conducting lines preferably join one another along the median plane, i.e., for each meander, an elongated strand from one of the lines joins an elongated strand of the other line.

The conducting lines each include a plurality of strands (at least two and preferably at least eight) elongated in the direction perpendicular to the median plane.

In a simple version, the antenna is entirely plane. In an even more compact version, the parts of the antenna are folded, for example in order to assume in part the shape of generally parallelepiped casing containing the antenna.

The antenna is formed on a, preferably flexible, printed circuit, or it is made up of a metal plate cut according to the required pattern of lines and ground plane. This plate can remain flat or can be matched to the required shape after cutting.

BRIEF DESCRIPTION OF THE DRAWINGS

Other characteristics and advantages of the invention will become apparent from a reading of the detailed description which follows, given with reference to the attached drawings, in which.

DETAILED DESCRIPTION

Figure 1:
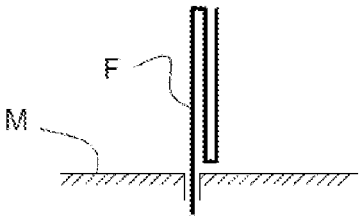
FIGS. 1 to 4, already described, show meander antenna principles of the prior art.
Figure 2:
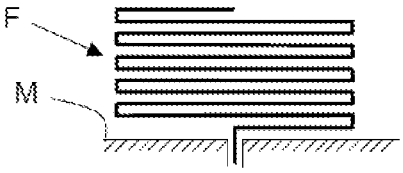
Figure 3:
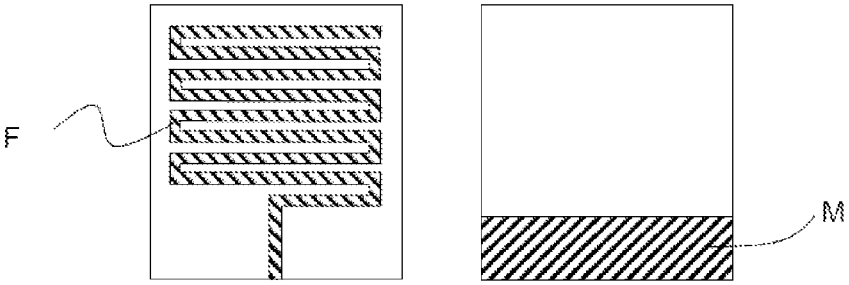
Figure 4:
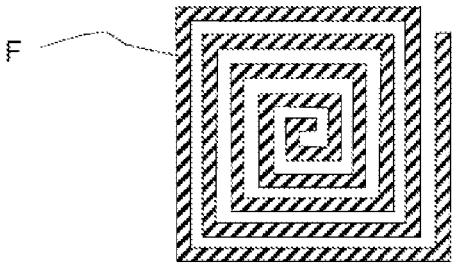
Figure 5:
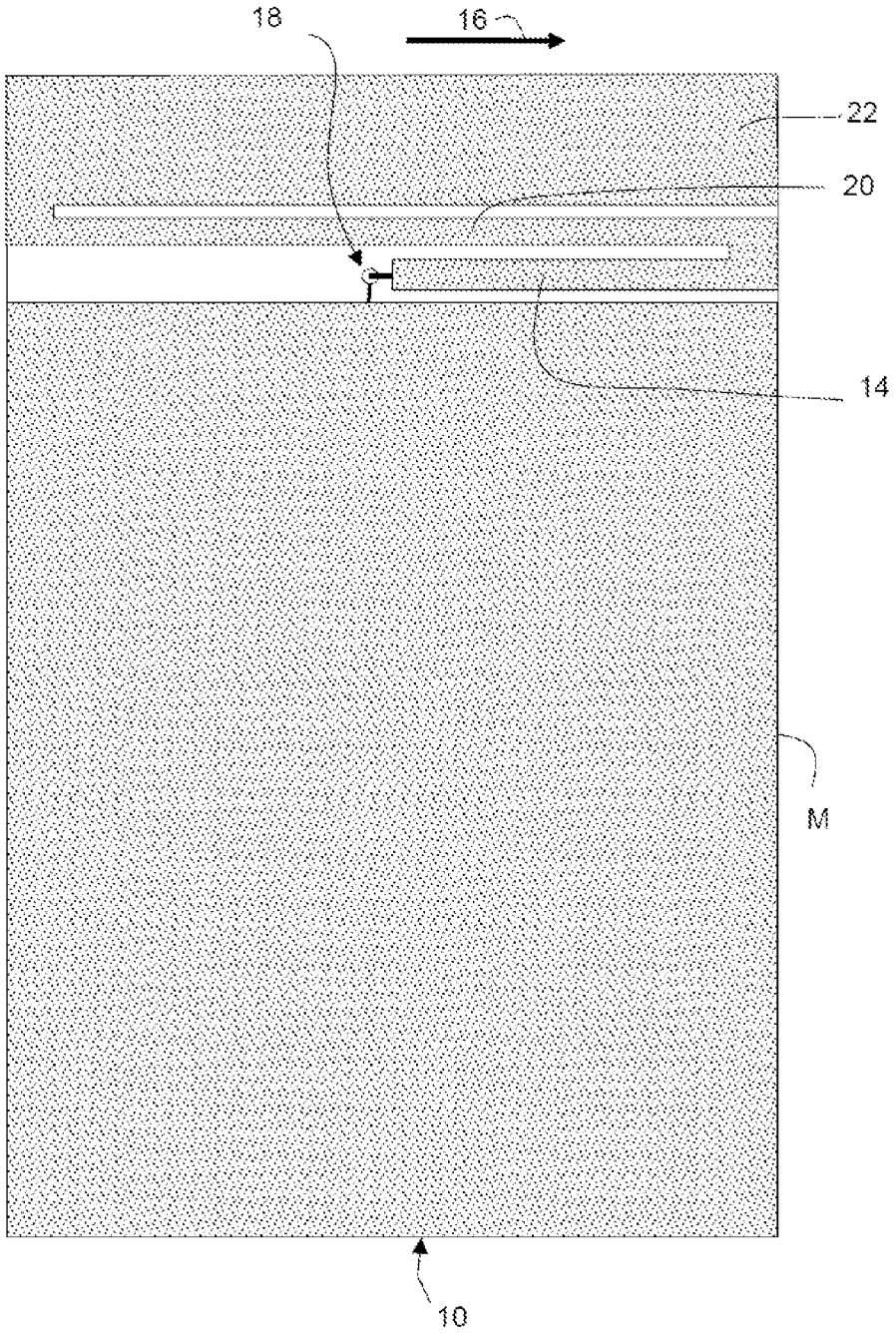
FIG. 5 shows a single meander antenna formed on a surface of a printed circuit.

FIG. 5 shows an example of a radio antenna intended to be incorporated in a communication casing capable of being handheld. The approximate dimensions of the casing are, for example, from 7 to 12 cm in length by 5 to 8 cm in width, with a thickness of around 1 to 3 cm. The antenna structure takes up the entire surface area or almost the entire surface area of the main (the largest) surface of the casing. It is preferably formed on a printed circuit board 10, the thickness of which may be 1 millimetre. These dimensions are given by way of indication. The radio communication is intended to use a carrier frequency of between 400 and 800 MHz, for example, and the antenna must therefore radiate a sufficient power for this frequency range. The antenna is used both for the transmission of radio signals and for reception.

The antenna is formed by a conducting surface etched onto a single surface of the printed board. The board is made, for example, from a plastic material (epoxy resin in general) and the conducting surface may be a layer of copper deposited on the board. However, the antenna could also be formed by cutting a metal plate without a plastic substrate.

The conducting surface includes a ground plane M and, in the same plane, an etched conducting structure which includes a single-meander, continuous conducting line. The conducting line includes a first elongated strand 14 extending parallel to an edge of the ground plane, in the direction of the width of the board (according to the direction of the arrow 16), with a constant narrow interval, for example 1 millimetre, between the first strand and the ground plane. This first strand starts from a point located in the middle of the width of the board, a point which forms a signal injection point for the antenna (for transmission) or signal reception point (for reception). The injection or reception point 18 is connected to a high-frequency transmission line (coaxial transmission cable or microstrip line) furthermore connected to the telecommunication circuitry (not shown) contained in the casing and located, for example, above the radio antenna board. This circuitry may include an integrated circuit for processing a radio-frequency signal.

As well as the first strand starting from the injection point, the continuous conducting line in FIG. 5 comprises a 180° double elbow and a second strand 20 which goes off in the opposite direction to the first strand, parallel to the first strand and at a short distance (for example 1 millimetre) and which occupies the entire width of the board. Finally, the conducting line ends in a terminal conducting surface 22 located on the other side of the conducting line in relation to the ground plane. This terminal conducting surface is separated from the second strand by a short distance, preferably equal to the distance between the strands, for example 1 millimetre. It occupies a significant proportion of the surface of the board, for example at least 15% of the surface, in this implementation. The continuous conducting line is referred to as a single-meander line, since it comprises a single double-elbow connecting two parallel elongated strands.

Figure 6:
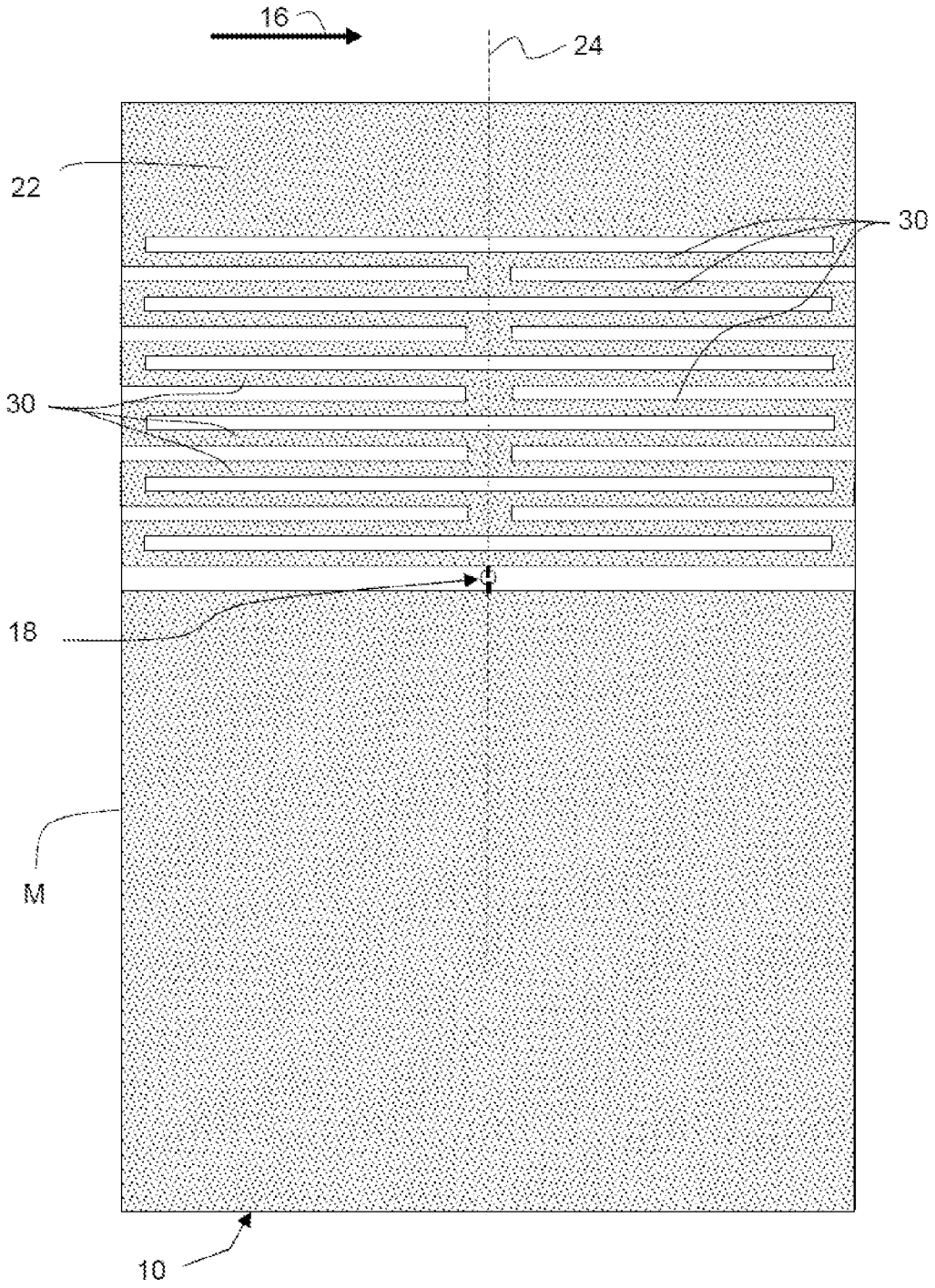
FIG. 6 shows a multiple meander antenna according to the invention, formed on a surface of a printed circuit.

FIG. 6 shows the improved antenna structure according to the invention, having an overall size similar or identical to that shown in FIG. 5. It is also formed on a single surface of the printed circuit board 10. This is a symmetrical structure comprising two continuous, symmetrical, multiple-meander conducting lines. The symmetry is a mirror symmetry in relation to a vertical median line 24 which crosses the board preferably in the direction of its longest length. There is a meander conducting line to the left of the median line and a meander line to the right of the median line.

A ground plane M occupies the lower part of the printed board, over a large surface area, in this example around half of the surface area of the board.

Each of the conducting lines comprises a plurality of parallel strands 30 in series, oriented perpendicular to the median line 24 and interconnected by 180° elbows. The elongated parallel strands are separated by narrow intervals, the width of which is of the same order of magnitude or is equal to the width of the strands themselves. They extend between one of the edges of the surface of the board and the median line. The 180° elbows are located on the ends of each strand, on one side along the median line and on the other side along one of the lateral edges of the board, the left edge for the strands of the left conducting line, the right edge for the strands of the right conducting line. There are a plurality of strands, preferably at least eight strands, per line. In the example shown, there are eleven strands.

Preferably, but this is not obligatory, the elbowed ends of the strands of the left conducting line can be joined to the elbowed ends of the right conducting line. This is what is shown in FIG. 6, where each of the elbows located on the right side of the left conducting line is coupled to one of the elbows located on the left side of the right conducting line. This structure where the elbowed ends of the left and right strands join along the median plan 24 ensures the mechanical stiffness of the ensemble, which is particularly advantageous when the structure is folded and/or integrated into a casing, e.g. as described with reference to FIG. 8.

The first strand (below the meander lines in FIG. 6) of each of the meander lines starts from a signal injection point 18 (which is a signal reception point if the antenna operates as a receive antenna). This point is located on the median line, between the ground plane M and the meander lines. The first strand of the left meander line therefore starts more or less from the injection point 18 to which it is connected and goes up to the left edge of the board. Similarly, the first strand of the right meander line starts from the injection point 18 to which it is connected and goes up to the right edge of the board.

Finally, the last strand of the left line (the strand at the top of the figure) ends on a common conducting surface 22 occupying a significant part of the board (at least 10%). The place where the last strand joins the common conducting surface is preferably the end of the strand on the side opposite to the median line, i.e. on the left edge and the right edge of the board respectively.

The common conducting surface 22 is separated from the last strand of each line (except where these strands join it) by a narrow interval which is preferably the same as the intervals between strands of each line.

The interval between strands and the interval between the last strand and the common conducting surface may be around 1 millimetre. The interval between the ground plane M and the first strand of each line may have the same value or may be greater if necessary in order to place the signal injection point 18 there, as shown in FIG. 6.

The antenna could thus be formed by cutting a metal plate rather than by etching a conducting layer deposited on a plastic board.

Figure 7:
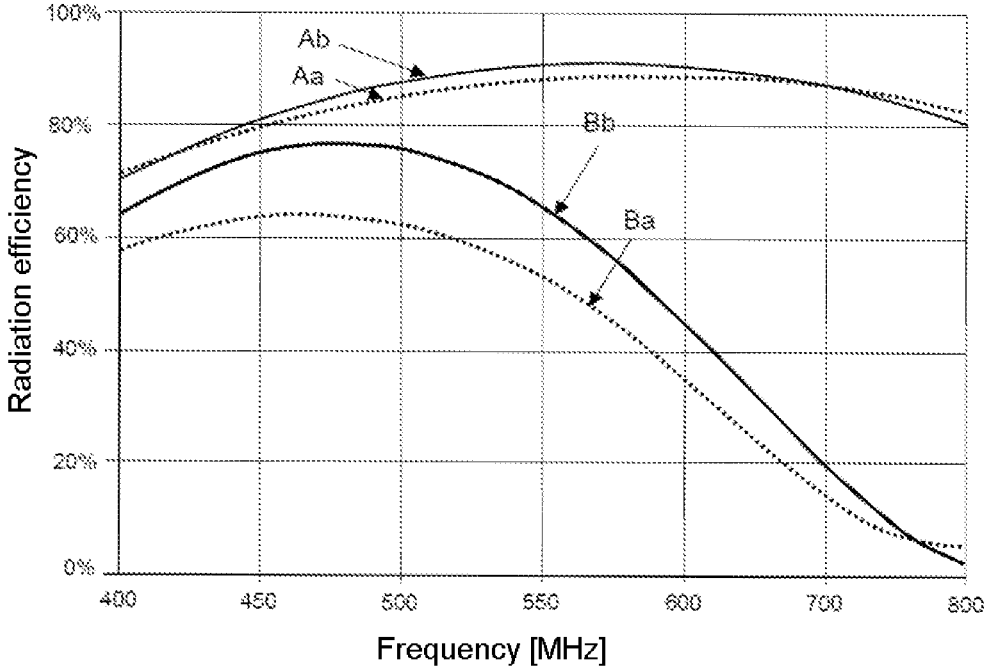
FIG. 7 shows a radiation efficiency curve of the antennas from FIGS. 5 and 6 in two different cases: an open-air antenna, and an antenna enclosed in a plastic hood.

FIG. 7 is a diagram showing the radiation efficiency of the antennas from FIGS. 5 and 6 under two different conditions. The radiation efficiency is expressed as a percentage from 0 to 100%, as a function of frequency. In the example shown, the frequency can vary between 400 and 800 MHz.

The first curve Aa, indicated by dotted lines, shows the variation in efficiency with frequency for an antenna from FIG. 5, in the open air.

The second curve Ab, indicated by unbroken lines, shows the variation for an antenna from FIG. 6.

These curves show that there is a frequency or a range of frequencies at which the efficiency is maximum. The efficiency reaches around 90%. It is slightly higher for the antenna from FIG. 6, but the difference compared with FIG. 5 is not very significant. The frequency at the top of the curve, i.e. the frequency at which the efficiency is maximum, is slightly lower for the antenna from FIG. 6. However, this value could be adjusted by modifying the precise dimensions of the etched conducting structure, and notably (for a given width of the board) the lengths and widths of the slots between conducting strands, and the widths of the conducting strands.

The third curve Ba, indicated by dotted lines, shows the variation in efficiency as a function of frequency for the antenna from FIG. 5 when it is enclosed in a hood made from a plastic material such as ABS (acrylonitrile butadiene styrene). It is evident, on the one hand, that the frequency at which the efficiency is maximum is much reduced compared with what it was when the antenna is in the open air (curve Aa). However, it is evident above all that the efficiency at the location of the maximum falls very significantly, since it no longer exceeds 65%. The influence of the hood results from the fact that the electric field lines around the antenna are disturbed by the presence of the hood.

The fourth curve Bb, indicated by unbroken lines, shows the variation in efficiency as a function of frequency for the antenna from FIG. 6 when it is enclosed in the same ABS hood. It is a curve similar to the curve Ba, with a significant fall in the frequency at the top of the curve. However, the maximum efficiency value is much higher, since it now exceeds 75%. The hood therefore interferes much less with the antenna from FIG. 6 than with the antenna from FIG. 5 (for a similar size for both antennas).

This can be explained by the fact that the areas of high electric field remain better distributed in the immediate vicinity of the antenna and are less influenced by the presence of the hood which covers the antenna. From this point of view, the antenna structure from FIG. 6 shows progress especially when the antenna is enclosed in a hood, which will most often be the case if the antenna is a communication antenna for a portable electronic casing.

In the entire description above, the antenna has been assumed to be completely plane. However, the structure formed by the ground plane M, the conducting lines 30 and the common surface 22 can also be folded in order to be accommodated in a space with a length and/or width smaller than the length and width of the plane antenna. For example, it can be provided that the fold is effected by keeping:

the ground plane mainly on a main front surface of a parallelepiped, the common surface 22 mainly on an opposite rear surface, and the conducting lines 30 mainly on a small side of the parallelepiped, between the two opposite surfaces.

Figure 8:
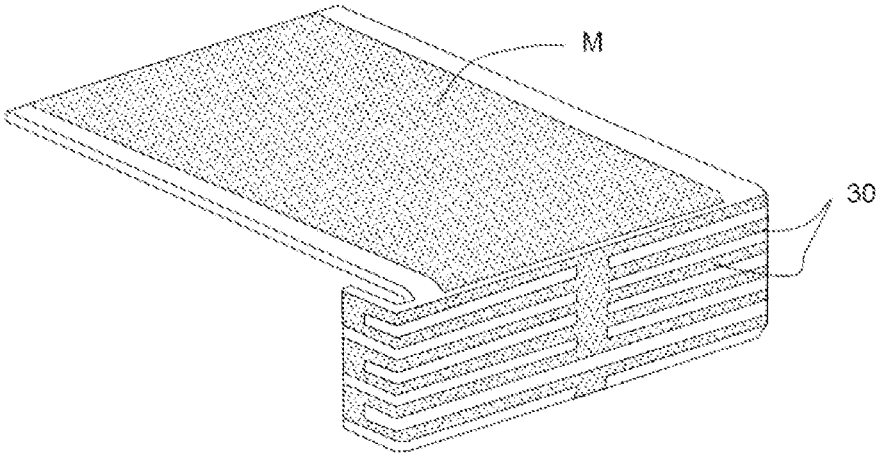
FIG. 8 shows a structure of an antenna in a folded configuration in order to be accommodated in a casing.

FIG. 8 shows what is understood by folding the conducting structure: in this example, the folding is effected at 90° to the ground plane M which occupies a part of a main surface of a parallelepiped. The strands 30 of the meander conducting lines are then disposed mainly on a small side of the parallelepiped, and they can themselves be folded over another side perpendicular to both the small side and the main surface. The surface 22, not shown, can be located below the main surface. The two multiple-meander conducting lines are then symmetrical in relation to a median plane perpendicular to the general direction of elongation of the conducting strands 30 (a plane containing the median line 24 from FIG. 6).

When the antenna is thus folded in part, the orientations of the strands and the symmetry as explained with regard to a plane antenna will be considered to remain valid, but by then considering that the antenna is hypothetically unfolded in order to consider these orientations.

The invention claimed is:

1. A monopole radio antenna, including a ground plane and an etched conducting surface, the etched conducting surface including a structure of conducting lines and a signal injection point, wherein the structure of conducting lines comprises a first meander conducting line having multiple strands elongated in a first direction, a second meander conducting line symmetrical to the first conducting line in relation to a median plane perpendicular to the first direction, the two lines starting from the injection point, and a common surface connected to the ends of the conducting lines distant from the injection point, and wherein the multiple strands of the two meander conducting lines join one another along the median plane.

2. The monopole radio antenna of claim 1, wherein the conducting lines each include a plurality of strands elongated in the direction perpendicular to the median plane.

3. The monopole radio antenna of claim 2, wherein said monopole radio antenna is entirely planar.

4. The monopole radio antenna of claim 2, wherein said monopole radio antenna is not planar and comprises folded parts to assume in part the shape of a generally parallelepiped casing.

5. The monopole radio antenna of claim 1, wherein said monopole radio antenna is entirely planar.

6. The monopole radio antenna of claim 1, wherein said monopole radio antenna is not planar and comprises folded parts to assume in part the shape of a generally parallelepiped casing.

* * * * *